United States Patent [19]

Furuya et al.

[11] Patent Number: 5,072,153

[45] Date of Patent: Dec. 10, 1991

[54] DISCHARGE TUBE FOR IGNITION APPARATUS

[75] Inventors: Tetsuo Furuya; Nobuto Tsujikawa, both of Fukuchiyama; Kazuhisa Mogi, Susono, all of Japan

[73] Assignees: West Electric Company, Ltd, Osaka; Toyota Jidosha Kabushiki Kaisha, Toyota, both of Japan

[21] Appl. No.: 511,435

[22] Filed: Apr. 13, 1990

[30] Foreign Application Priority Data

Apr. 14, 1989 [JP] Japan ..... 1-95795
Aug. 18, 1989 [JP] Japan ..... 1-213857

[51] Int. Cl.[5] ..... H01J 17/16; H01J 17/04

[52] U.S. Cl. ..... 313/603; 313/634; 361/120

[58] Field of Search ..... 313/603, 623, 631, 634; 361/212, 220, 120; 337/28

[56] References Cited

U.S. PATENT DOCUMENTS 3,906,273 9/1975 Kozlowski ..... 313/634 X

FOREIGN PATENT DOCUMENTS 63-175315 7/1988 Japan .
1313873 12/1989 Japan .
63-243024 3/1990 Japan .
2-94279 4/1990 Japan .
2-94280 4/1990 Japan .

*Primary Examiner*—Sandra L. O'Shea
*Attorney, Agent, or Firm*—Cushman, Darby & Cushman

[57] ABSTRACT

A discharge tube for an ignition apparatus is composed of a tube-shaped casing made of electrical insulating material which is closed at both end parts with end members, the end members have openings which are smaller in diameter than the inner diameter of the casing, both the openings are sealed by metallic sealing members, respectively, and a thickness of the wall of the casing, an inner diameter and an outer diameter of the casing and a distance between both the end members are restricted within predetermined ranges.

10 Claims, 5 Drawing Sheets

FIG.6 (General Art)
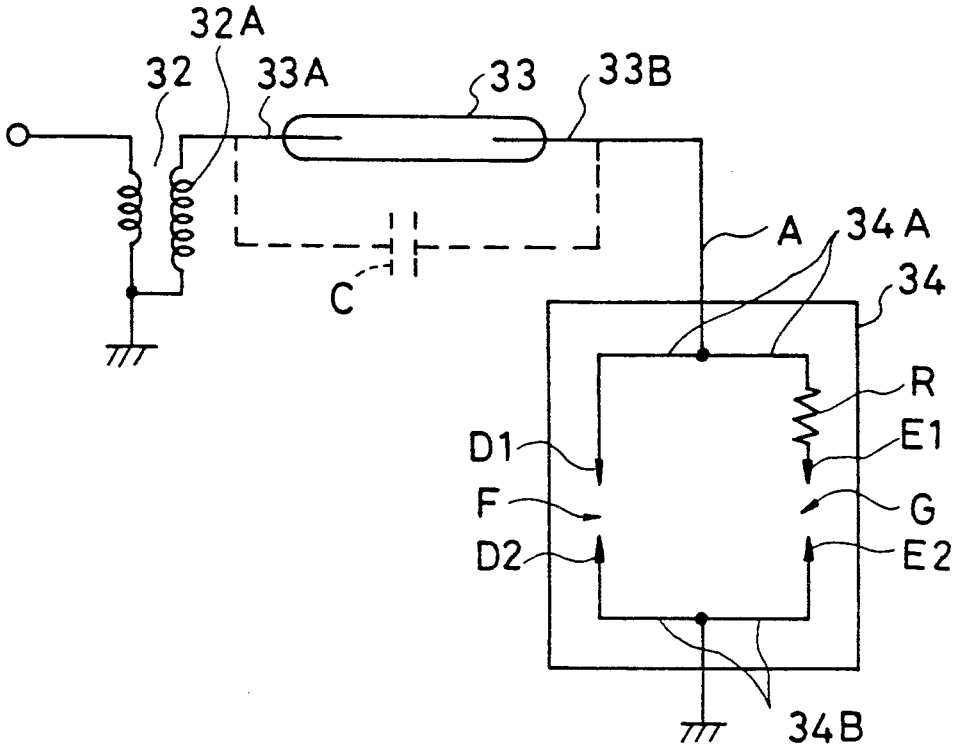
FIG.7 (General Art)
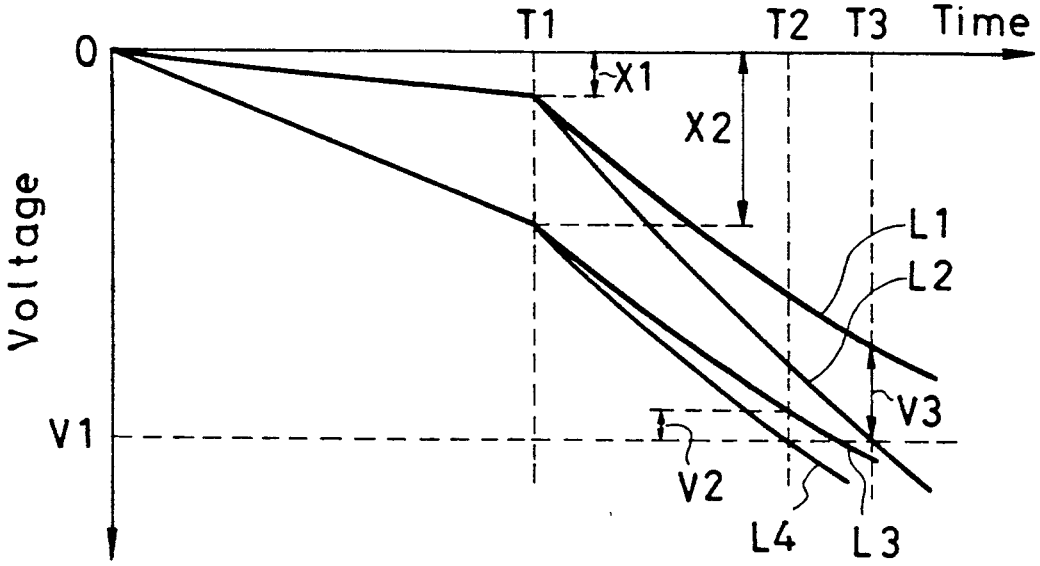

DISCHARGE TUBE FOR IGNITION APPARATUS

FIELD OF THE INVENTION AND RELATED ART STATEMENT

1. Field of the Invention

The present invention relates to a discharge tube which is to be connected in series to a spark plug in an ignition apparatus of an internal combustion engine.

2. Description of the Related Art

A discharge tube for an ignition apparatus of an internal combustion engine is disclosed in the U.S. Pat. No. 3,995,183 and the Japanese Published unexamined Patent Application Hei 1-313873, for example.

FIG. 4 and FIG. 5(*a*) are cross-sectional views of the discharge tubes disclosed in the U.S. Pat. No. 3,995,183 and the Japanese Patent Application laid open as Publication No. 1-313873 on Dec. 19, 1989, respectively.

In the discharge tube shown in FIG. 4, electrically conductive electrodes 23, 23, are inserted in both ends of a tube-shaped electrical insulating member 24, and airtight sealing is applied at the joint between the insulating member 24 and the electrodes 23, 23. The electrodes 23, 23 are provided with a layer 25 of fire resistant conductive material on each protruded portion 23A.

In the discharge tube shown in FIG. 5(*a*), a tube-shaped container 30 made of electrical insulating material such as ceramics is sealed at both the end openings with metallic sealing members 28, 29 by using sealing glass 28A. The metallic sealing member 28 is provided with an electrode 26, and the metallic sealing member 29 is provided with an electrode 27. Then, an inert gas such as xenon gas is filled in the chamber 31.

FIG. 5(*b*) is a perspective view of another example of the discharge tube in the Japanese patent application laid open as Publication No. 2-94280 on Apr. 5, 1990. This discharge tube is configurated similar to the discharge tube shown in FIG. 5(*a*), but the diameter of an opening 28B is reduced, and hence a metallic sealing member 28C is miniaturized.

An ignition voltage applied to a spark plug in the ignition apparatus of the internal combustion engine is 10–25 kv in a recent example. The discharge tube discharges when a predetermined constant voltage is applied across both the electrodes. In order to prevent harmful influence to the ignition voltage due to "carbon fouling" of the spark plug, use of the above-mentioned discharge tube is effective. However, in order to maintain a stable ignition voltage, the discharge tube which is not only higher in a discharge starting voltage but also lower in capacitance is required.

FIG. 6 is an equivalent circuit of the relevant parts of an ignition apparatus. Referring to FIG. 6, one terminal of a secondary coil 32A of an ignition coil 32 is connected to an electrode 33A of a discharge tube 33. The other electrode 33B of the discharge tube 33 is connected to a spark plug 34 via a wire A. A capacitor C shown by a dotted line is a stray capacitance of the discharge tube 33.

In the spark plug 34, a spark gap F shows a gap between parts D1 and D2 of the electrodes 34A and 34B of the spark plug 34. Other spark gap G shows a gap between parts E1 and E2 of the electrodes 34A and 34B of the spark plug 34. The parts D1 and D2 are clean, but the parts E1 and E2 are fouled with carbon. A resistor R shows a resistance caused by the carbon adhering on the parts E1 and E2.

FIG. 7 shows voltage variations at the parts D1 and E1. A voltage which is applied to the spark plug 34 at the time T1 is varied according to the capacitance C of the discharge tube 33. The discharge tube 33 starts discharge at the time T1. In case where the capacitance C is relatively small, the voltages at the parts E1 and D1 are shown by curves L1 and L2, respectively. On the other hand, in case where the capacitance C is relatively large, the voltage at the parts E1 and D1 are shown by the curves L3 and L4, respectively. A voltage V1 is a discharge voltage of the spark plug 34 in idling operation of the engine.

Referring to the curves L1 and L2 in FIG. 7 (in the case of small capacitance), when the voltage applied to the part D1 (shown by curve L2) reaches the voltage V1 at a time T3, the voltage at the part E1 (shown by curve L1) has not yet reached the voltage V1. In case the capacitance C is small, a relatively large voltage difference V3 exists between the curves L1 and L2, and hence the probability of undesirable sparking in the spark gap G is relatively low.

On the other hand, referring to the curves L3 and L4 (in the case of large capacitance), since a relatively small voltage difference V2 exists between the curves L3 and L4, and hence the probability of undesirable sparking in the spark gap G is relatively high. Additionally, in case where the discharge tube 33 also has a large capacitance C, necessary steep voltage is not applied to the spark plug 34.

Additionally, in case that the discharge tube 33 has a small capacitance C, since a steep voltage is applied to the spark plug 34, an energy of spark does not flow in the gap G, but flows in the gap F of the spark plug 34.

In view of the above-mentioned problem, the capacitance C should be reduced as small as possible. However, the capacitance C of the discharge tube in the prior art can not be reduced to less than some value. Additionally, stable control in a mass production line of the value has been difficult. That is, stable supply of energy only to the spark plug 34 has not been realized.

OBJECT AND SUMMARY OF THE INVENTION

An object of the present invention is to provide a discharge tube for an ignition apparatus having a small capacitance.

The discharge tube for the ignition apparatus in accordance with the present invention comprises:

- a tube-shaped casing made of electrical insulating material closed at both end parts by end members made of electrical insulating material having openings at substantially central position of the end members being smaller in diameter than an inner diameter of the casing,
- a first metallic sealing member for sealing one of the openings, having a first electrode,
- a second metallic sealing member for sealing the other opening, having a second electrode, and
- an inert gas filled in the tube-shaped casing.

While the novel features of the invention are set forth particularly in the appended claims, the invention, both as to organization and content, will be better understood and appreciated, along with other objects and features thereof, from the following detailed description taken in conjunction with the drawings.

BRIEF DESCRIPTION OF THE DRAWINGS

FIG. 1(*b*) is a perspective view of a second member of the casing of the discharge tube in the first embodiment;

FIG. 1(*c*) is a perspective view of a first metallic sealing member in the embodiment;

FIG. 1(*d*) is a perspective view of a second metallic sealing member in the embodiment.

FIG. 1(*e*) is a cross-sectional view of an assembled discharge tube in the first embodiment;

FIG. 2(*b*) is a perspective view of a second member of the casing of the discharge tube in the second embodiment;

FIG. 2(*c*) is a cross-sectional view of an assembled discharge tube in the second embodiment;

FIG. 6 is the equivalent circuit of the relevant part of the ignition apparatus in the general art;

FIG. 7 is the graph of voltage variations in the general art.

Figure 1A:
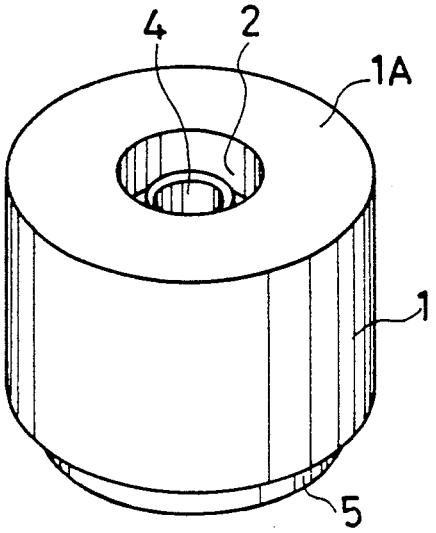
FIG. 1(*a*) is a perspective view of a first member of a casing of a discharge tube in a first embodiment in accordance with the present invention.
Figure 1C:
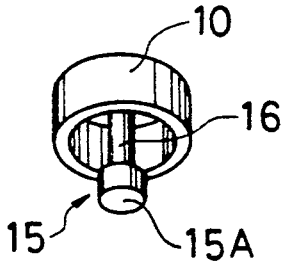
Figure 1D:
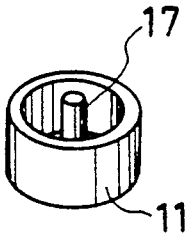
Figure 1B:
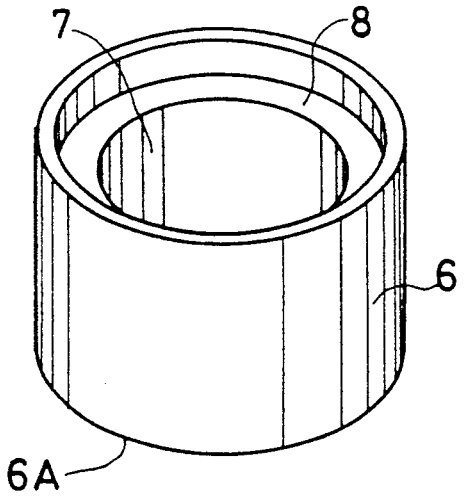
Figure 1E:
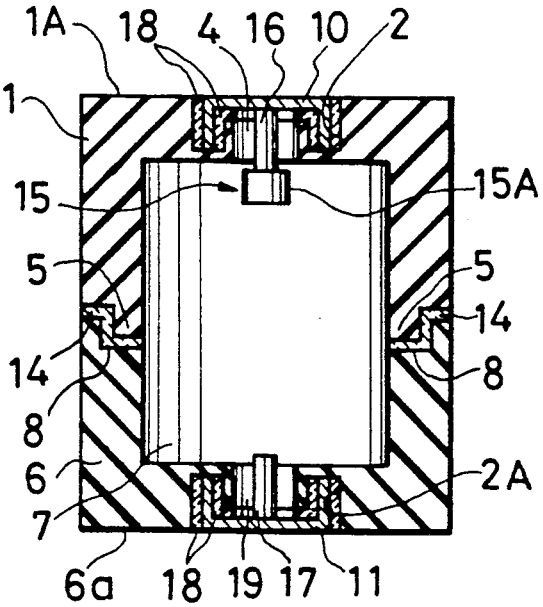

It will be recognized that some or all of the Figures are schematic representations for purposes of illustration and do not necessarily depict the actual relative sizes or locations of the elements shown.

DESCRIPTION OF THE PREFERRED EMBODIMENT

FIG. 1(*a*) is a perspective view of a tumbler-shaped first member 1 for forming a casing of a discharge tube of a first embodiment in the present invention. The first member 1 is provided with a circular trough 2 on the surface of the end plate 1A thereof. Moreover, a circular opening 4 is disposed at the center of the circular trough 2. A protruding ring-shaped terrace part 5 is formed on the other end part of the first member 1.

FIG. 1(*b*) is a perspective view of a tumbler-shaped second member 6 for forming the casing. Referring to FIG. 1(*b*), an offset ring-shaped terrace part 8 is formed on the upper end part of the second member 6. Both the first and second members 1 and 6 are made of electrical insulating material such as ceramic. In assembly of the casing, the first member and the second member 6 are joined at the ring-shaped terrace parts 5 and 8 and are bonded by seal glass or by the known metallizing method. In the above-mentioned sealing process, the first and second members 1 and 6 are heated to adhere each other by seal glass 14.

The second member 6 also has a circular trough 2A (It is hidden in FIG. 1(*b*), but shown in FIG. 1(*e*)) on its bottom surface 6A. Moreover, an opening 19 is formed at the center of the circular trough 2A.

FIGS. 1(*c*) and 1(*d*) are perspective views of metallic sealing members 10 and 11, respectively. The metallic sealing member 10 is provided with an electrode 15 on the center of the bottom thereof. The electrode 15 is composed of a metallic rod 16 and the known sintered body 15A which is made by sintering metallic powder of tungsten, molybdenum or the like. On the other hand, the metallic sealing member 11 is provided with an electrode 17 of a metallic rod on the center of the bottom thereof as shown in FIG. 1(*d*). The metallic rod 16 and the electrode 17 are made of one material selected from the group consisting of tungsten, molybdenum, tantalum and alloys of these metals.

Subsequently, as shown in FIG. 1(*e*), the first metallic sealing member 10 is inserted in the trough 2 of the first member 1 and is adhered by seal glass 18 to seal the opening 4.

Thereafter, the casing is filled with an inert gas, and the opening 19 of the second member 6 is sealed with the metallic sealing member 11 using seal glass 18.

A method of filling the inert gas is disclosed in the Japanese Published Unexamined Application Sho 63-175315, and the elucidation is omitted.

Figure 2A:
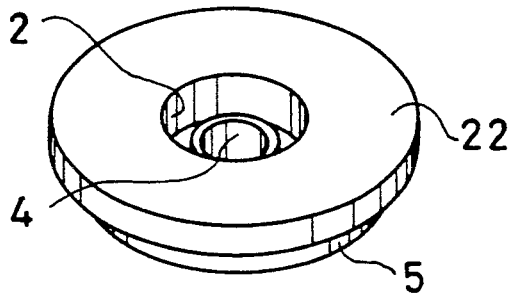
FIG. 2(*a*) is a perspective view of a first member of a casing of the discharge tube in a second embodiment in accordance with the present invention.
Figure 2B:
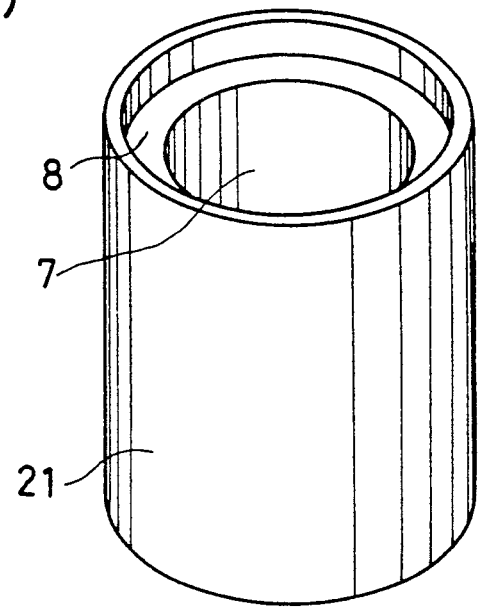
Figure 2C:
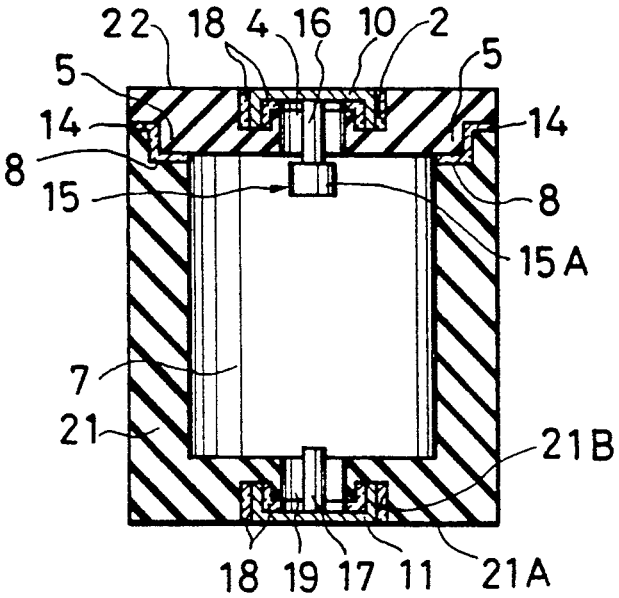

FIGS. 2(*a*) and 2(*b*) are perspective views of parts of a casing in a second embodiment in accordance with the present invention. In the second embodiment, as shown in FIG. 2(*b*), a tumbler-shaped member 21 for forming the casing is provided with a ring-shaped terrace part 8 on the upper end thereof. Referring to FIG. 2(*a*), a disc-shaped top plate 22 for covering the opening of the member 21 is provided with a ring-shaped terrace part 5 on the circumferential part, and a circular trough 2 is formed at the center of the upper surface thereof. Moreover, an opening 4 is formed at the center of the trough 2. As shown in FIG. 2(*c*), a circular trough 21B and an opening 19 are provided on the bottom 21A of the member 21, but these are hidden in FIG. 2(*b*).

FIG. 2(*c*) is a cross-sectional view of the assembled discharge tube of the second embodiment. Referring to FIG. 2(*c*), the top plate 22 is inserted in the opening of the tumbler-shaped member 21 and is bonded by seal glass 14. Then the metallic sealing member 10 shown in FIG. 1(*c*) is inserted in the trough 2 of the top plate 22 and is bonded with seal glass 18. Thereafter, the chamber 7 of the casing is filled with an inert gas, and the opening 19 is sealed by the metallic sealing member 11 shown in FIG. 1(*d*) in a manner similar to the first embodiment.

A capacitance of the discharge tube in accordance with the present invention is compared with that of the prior art.

Figure 3:
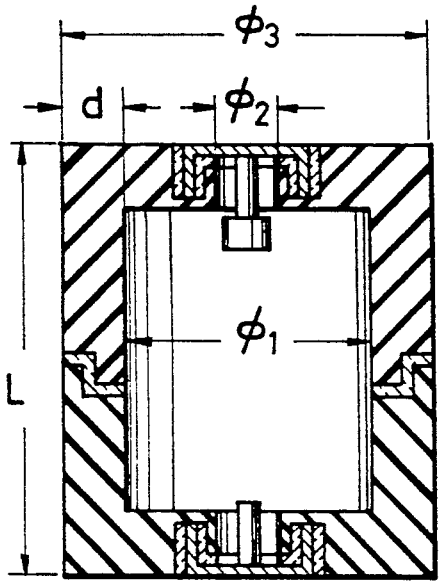
FIG. 3 is a cross-sectional view of the discharge tube of the first embodiment having dimension lines.
Figure 4:
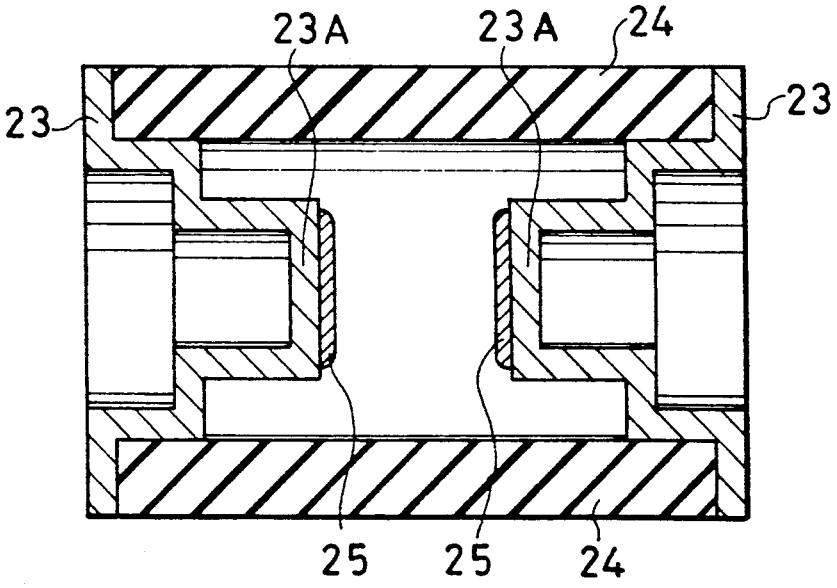
FIG.4 (Prior Art)
FIG. 4 is the cross-sectional view of the discharge tube in the prior art.

Referring to the discharge tube of the first embodiment, as shown in FIG. 3, the inner diameter of the casing is represented by $\phi_1$, the diameter of the opening 4 is represented by $\phi_2$, and the outer diameter of the casing is represented by $\phi_3$. The thickness of the wall of the casing is represented by d, and the entire length of the casing is represented by L. The capacitance of the discharge tube having predetermined values in the dimensions $\phi_1$, $\phi_2$, $\phi_3$, d and L, is measured. The resultant capacitance is 0.23 picofarad.

Figure 5A:
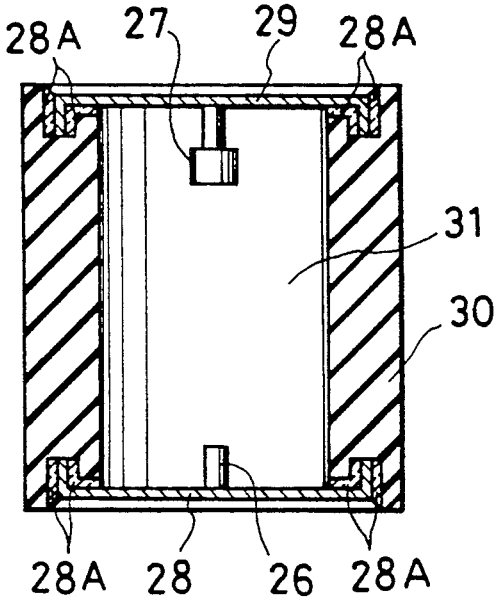
FIG.5(a)(Prior Art)
FIGS. 5(*a*) and 5(*b*) are the cross-sectional views of the discharge tube in the prior art.
Figure 5B:
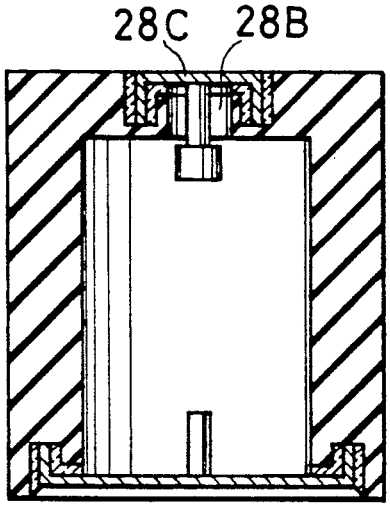
FIG.5(b)(Prior Art)

On the other hand, in the discharge tubes in the prior art shown in FIGS. 5(*a*) and 5(*b*), the capacitances are 0.45 picofarad and 0.3 picofarad, respectively, in the common dimensions and the common pressure of the inert gas.

Consequently, the capacitance of discharge tube of the first embodiment is reduced.

In general, the capacitance is preferably as low as 1 picofarad in order to serve as the discharge tube for the ignition apparatus. In order to realize a discharge tube having a capacitance which is less than 1 picofarad, when the entire length L of the discharge tube is 10 mm—30 mm and the thickness of the wall of the casing is 0.5 mm—5.0 mm, the inner diameter $\phi_1$ and the diameter $\phi_2$ of the openings 4 and 19 must be determined by the relation (1):

$$2\ \text{mm} \leqq \phi_2 < \phi_1 \leqq 20\ \text{mm} \quad (1)$$

The longer the overall length L is, the smaller the capacitance becomes, but the overall length is restricted to 30 mm taking into account assembly into the ignition apparatus.

Additionally, the thicker the thickness "d" of the wall is, the smaller the capacitance becomes, but the thickness of 0.5 mm or more is required to hold a mechanical strength in environment of the automobile engine. On the contrary, when the thickness "d" is too great, charging of the inert gas is difficult since the capacity of the chamber 7 of the discharge tube is decreased. On the other hand, in order to increase the volume of the chamber 7 in the discharge tube having such a thick wall, outer diameter $\phi_3$ must be increased. Consequently, there is a difficulty in assembly in the ignition apparatus. Moreover, the cost of material becomes expensive. Hence, the thickness "d" is required to be 5.0 mm and below.

As mentioned above, according to the present invention, since the diameter of the opening disposed on the end parts of the casing of the discharge tube is smaller than the inner diameter of the casing, the area of the metallic sealing member for sealing the opening can be reduced. As a result, the capacitance in the entire discharge tube can be significantly reduced, and a stable discharge in the spark plug can be expected.

Although the invention has been described in its preferred form with a certain degree of particularity, it is understood that the present disclosure of the preferred form has been changed in the details of construction and the combination and arrangement of parts may be resorted to without departing from the spirit and the scope of the invention as hereinafter claimed.

What is claimed is:

1. A discharge tube for an ignition apparatus comprising:

a tube-shaped casing made of electrical insulating material and closed at both end parts by end members made of electrical insulating material, each said end member having openings at a substantially central position of said end members, said openings being smaller in diameter than an inner diameter of said casing, a first metallic sealing member for sealing one of said openings, having a first electrode which is integral therewith, a second metallic sealing member for sealing the other opening. having a second electrode which is integral therewith, both said first and second sealing members formed of one single piece of metal, and an inert gas filled in said tube-shaped casing.

2. A discharge tube for an ignition apparatus in accordance with claim 1, wherein when the inner diameter of said tube-shaped casing is represented by $\phi_1$, the diameter of said opening is represented by $\phi_2$, a thickness of the wall of said tube-shaped casing is represented by "d", and a distance between both the end members is represented by L, and wherein $0.5\ \text{mm} \leqq d \leqq 5.0\ \text{mm}$, $10\ \text{mm} \leqq L \leqq 30\ \text{mm}$, $\phi_1 \leqq 20\ \text{mm}$, $\phi_2 < \phi_1$, and $\phi_2 \geqq 2\ \text{mm}$.

3. A discharge tube for an ignition apparatus in accordance with claim 1, wherein at least one of said end members is adhered to said tube-shaped casing by seal glass or a metallizing method.

4. A discharge tube for an ignition apparatus in accordance with claim 1, wherein said tube-shaped casing is composed of two parts which are adhered to each other by seal glass or a metallizing method.

5. A discharge tube as in claim 1 wherein each said metallic sealing member has said electrode on a first surface thereof, and a second surface of each said sealing member opposite to said first surface is substantially flat.

6. A tube as in claim 5 wherein said substantially flat second surface is substantially coplanar with a top surface of each said end member.

7. A tube as in claim 1 wherein said opening formed in each said end member includes a first opening formed in a top surface of said end member and a second opening of a smaller size than said first opening formed in a bottom surface of said end member, and wherein said sealing member includes a first surface having a diameter similar to and adapted to couple with said first opening, and mating therewith, said electrode of each said sealing member being sufficiently small to fit through said second opening.

8. A discharge tube for an ignition apparatus comprising:

a first casing part including an end part and a collar at an opposite end from said end part, said first casing part being of a substantially cylindrical form with said end closing one end of said cylindrical form;

a second casing part, having a surface adapted to mate with said collar of said first casing part, and including at least a second end part which closes the other end of said cylindrical form, each of said first and second casing parts including openings in said end parts thereof, each said opening being smaller than an inner diameter of said cylindrical form, first and second sealing/electrode members, including a sealing portion and an electrode portion, sealing said openings and disposing said electrodes through said openings, and, wherein said sealing/electrodes members are one continuous piece of metal.

9. A tube as in claim 8 wherein said opening formed in each said end member includes a first opening formed in a top surface of said end member and a second opening of a smaller size than said first opening formed in a bottom surface of said end member, and wherein said sealing member includes a first surface having a diameter similar to and adapted to couple with said first opening, and mating therewith, said electrode of each said sealing member being sufficiently small to fit through said second opening.

10. A tube as in claim 8 wherein each said metallic sealing member has said electrode on a first surface thereof, and a second surface of each said sealing member opposite to said first surface is substantially flat and wherein said substantially flat second surface is substantially coplanar with a top surface of each said end member.

* * * * *